United States Patent [19]

Weber et al.

[11] Patent Number: 4,474,715

[45] Date of Patent: Oct. 2, 1984

[54] PYROTECHNIC SMOKE CHARGE WITH PRESET BREAKING POINTS AND CHANNEL IGNITOR

[75] Inventors: Manfred Weber; Friedmar Hinzmann, both of Eisenberg, Fed. Rep. of Germany

[73] Assignee: Pyrotechnische Fabrik F. Feistel GmbH & Co., KG, Gollheim, Fed. Rep. of Germany

[21] Appl. No.: 293,909

[22] Filed: Aug. 18, 1981

[30] Foreign Application Priority Data

Aug. 20, 1980 [DE] Fed. Rep. of Germany ..... 3031369

[51] Int. Cl.[3] ..... C06B 21/00

[52] U.S. Cl. ..... 264/3 C; 149/42; 149/76; 102/288; 102/334; 102/289; 86/20 B; 86/20 D

[58] Field of Search ..... 149/40, 117, 42, 76; 102/334, 288, 289, 292; 264/3 R, 3 C; 86/20 R, 20 B, 20 D

[56] References Cited

U.S. PATENT DOCUMENTS

| | | | |
|---|---|---|---|
| 2,995,526 | 8/1961 | De Ment | 149/81 X |
| 3,025,153 | 3/1962 | Cross | 149/40 |
| 3,376,175 | 4/1968 | Sheeline | 149/114 X |
| 3,389,027 | 6/1968 | Stevenson | 149/114 X |
| 3,629,129 | 12/1971 | Lehikoinen | 102/334 X |
| 3,986,909 | 10/1976 | Macri | 149/114 X |
| 4,007,691 | 2/1977 | Haake | 102/334 |
| 4,089,715 | 5/1978 | Scherzinger | 149/114 X |
| 4,115,165 | 9/1978 | Machacek | 149/114 X |
| 4,256,521 | 3/1981 | Scherzinger | 149/114 X |

FOREIGN PATENT DOCUMENTS

| | | | |
|---|---|---|---|
| 2854120 | 6/1980 | Fed. Rep. of Germany | 102/334 |

*Primary Examiner*—Peter A. Nelson

*Attorney, Agent, or Firm*—Burton, Parker & Schramm

[57] ABSTRACT

Described is a pyrotechnic charge as smoke- or combustion charge in the form of separate pressed objects arranged in a case, the improvement comprising the fact that the case (1) for the pressed objects (3) consists of plastic or light metal provided with preset breaking points (2). More specifically, the pyrotechnic charge contains a charge base containing smoke compounds in the form of pressed objects and also contains an igniting charge.

18 Claims, 5 Drawing Figures

PYROTECHNIC SMOKE CHARGE WITH PRESET BREAKING POINTS AND CHANNEL IGNITOR

BACKGROUND OF THE INVENTION

The invention concerns a pyrotechnic charge as a smoke or as a combustion charge in the form of pressed objects separately arranged in a case, in any case with an igniting charge, and processes for their production.

There are numerous kinds of smoke producing substances or substance mixtures as well as devices known which discharge them into or over an objective area. Ordinarily, the smoke mixtures are molded and pressed to pressed objects, stacked in a metal case, and with ignition, in any case with the use of an igniting charge, are expelled from the case opening, whereby they are distributed conically like a shot of slugs.

From the German Patent Disclosure Publication No. 19 13 790 a device is known for the production of an artificial smoke screen in which the pressed objects are stacked in a burst proof case around an ignition pipe. This device has substantial disadvantages. Thus, the space in the case is not optimally used by the segmented pressed objects stacked in it. Rather, hollow spaces are present which lower the charge density. Besides, especially with the production and transport, an increased proportion of dust forms on the border surfaces of the pressed object by abrasion of the smoke charge, which causes material losses. Finally, also the industrial manufacturing expense for the production of the segmented pressed objects as well as for their insertion into a charge case with the use of an igniting pipe is considerable.

Known combustion charges are constructed correspondingly.

Further disadvantages of this kind of known pyrotechnic charges results from the expulsion principle. Since the expulsion of the pressed objects takes place only in one direction, a limitation of the area coverage is inevitably preset. The area coverage is thus always dependent on the expulsion height and cannot be varied with expulsion like a shot of slugs, which is especially disadvantageous with smoke charges, but also can be of significance with combustion charges.

Furthermore, an additional material loss arises by the expulsion in one direction on the basis of the friction of the pressed object along the case. Besides, the individual segments are constituted in such a way that they are partly destroyed to small particles by the pressure load occurring with the ignition.

A further disadvantage of the known charges lies in the central arrangement of a spray pipe as an ignition pipe, whereby a direct contact between the igniting column and the smoke object is not obtained.

The case, generally consisting of metal, from which the smoke or combustion charges are expelled to a definite height, subsequently falls to the ground unharmed in one piece, and can under unfavorable circumstances cause serious injuries.

A further disadvantage of the known charges used as smoke charges originates from the composition of the smoke mixtures. These frequently react acid or evolve phosphorous pentoxide which is converted to phosphoric acid, and cause breathing difficulties and stimulate coughing or attack internal organs. These kinds of disadvantages are especially undesired if one thinks of the use of smoke charges in vineyard areas for frost prevention, or with use for training and military maneuver purposes.

Various smoke and fog compounds are known. For instance, a smoke or fog charge is described in German Patent Application DE-AS No. 24 51 701 which contains an organic chlorine donor, metal powder and/or metal oxide. The known smoke charge contains as a binder at least one of the high molecular chlorine donors: chloroparaffin, chlorinated polyphenylene, chlorinated polyphenoxy resin and polyester of tetrachlorophthalic acid with chlorinated polyalcohol.

Disadvantageous with these known smoke charges are their causing of a stimulus for coughing, and as a function of their exact composition, their more or less toxic properties. Other smoke and fog charges consist of a mixture of hexachloroethane with metal powder, such as zinc, aluminum, titanium, magnesium and iron.

These mixtures have the disadvantage that the hexachloroethane is very hydrolysis sensitive and easily reacts already in the production process with water vapor or moisture. Moreover, these kinds of mixtures are less storage stable and are inclined to burning time changes.

The usual igniting charges for combustion or smoke charges have as the main constituents magnesium powder, black powder flour and a binder. They possess the disadvantage that they do not ignite under clearly defined conditions and, moreover, are only lowly mechanically loadable.

Another smoke charge is known from German Patent Application DE-OS No. 27 43 363. As constitutents it has zinc oxide, ammonium perchlorate, polychloroisoprene, as well as a plasticizer, and ammonium chloride for buffering. This smoke charge has the disadvantage that carcinogenic combustion products form with the combustion. Furthermore, the process for its production is very expensive, since it is cast, and must be provided with two coatings for stabilization and for protection against external influences.

It is the problem of the invention to specify a pyrotechnic charge as smoke or as combustion charge in the form of separate pressed objects arranged in a case, which is simply and cheaply producible and makes possible a better distribution of the smoke or combustion charges. It is a further problem of the invention to make available, compared to the state of the technology, an improved new mixture for a smoke, combustion and igniting charge as well as processes for their production.

SUMMARY OF THE INVENTION

Described is a pyrotechnic charge as smoke or combustion charge in the form of separate pressed objects arranged in a shell in such a way that the case for the pressed objects consists of plastic or light metal provided with preset breaking points. A case of this kind bursts easily after the ignition and therefore insures a better spatial distribution of the smoke or combustion charge. Besides, only small case pieces remain, so that an injury danger is not produced by this.

BRIEF DESCRIPTION OF THE DRAWINGS

In the following, the invention is explained in more detail by means of type examples with reference to the drawings. They show.

DESCRIPTION OF PREFERRED EMBODIMENTS

Preferably, the pressed objects are provided with grooves and arranged in layers above one another. By this arrangement of the pressed objects, their better decomposition is insured and therewith a better spatial distribution is also achieved.

It is advantageous that the grooves of all the pressed objects form a continuous channel in which separately acting igniting charges are arranged filling the space. Hereby, an additionally ignition pipe is unnecessary and the friction between the separate pressed objects is excluded.

A pyrotechnic charge as a smoke or combustion charge is preferably arranged in a cylindrical case 1. The case 1 (FIG. 1) is provided with lengthwise and/or lateral preset breaking points 2. These can be produced as notches or breaking lines constructed on the inner side of the case 1, or in the form of thinned material. The case 1 consists of a plastic, but can also consist of a light metal such as for example aluminum or of a light metal alloy.

Figure 1:
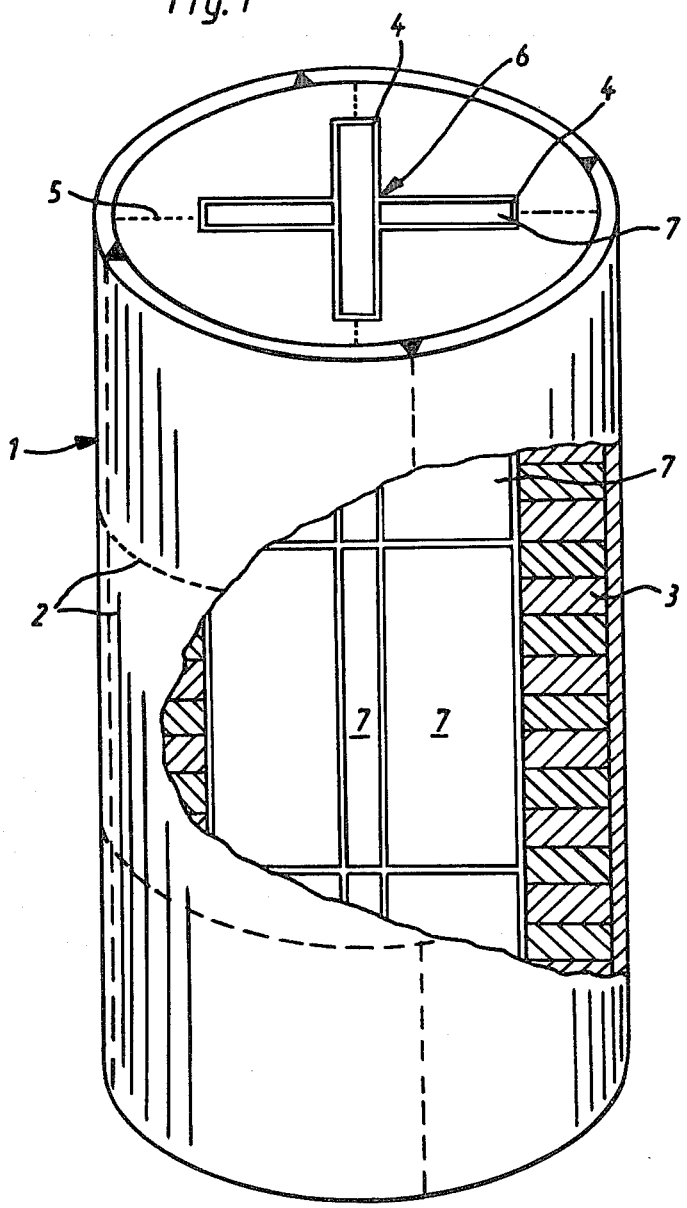
FIG. 1—A pyrotechnic charge of pressed objects with igniting charge in a case.
Figure 2A:
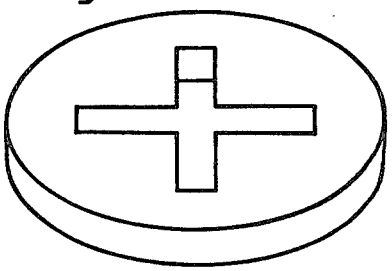
FIG. 2*a*—A pressed object in perspective presentation.
Figure 2B:
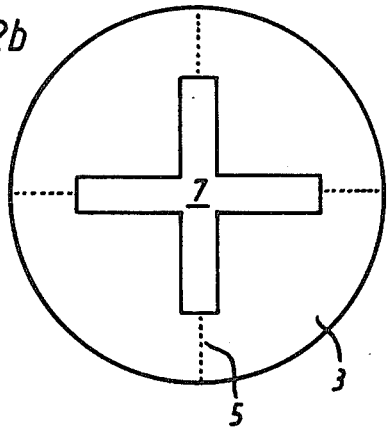
FIGS. 2*b–d*—The decomposition of a pressed object after the ignition of the igniting charge, in a top view.
Figure 2C:
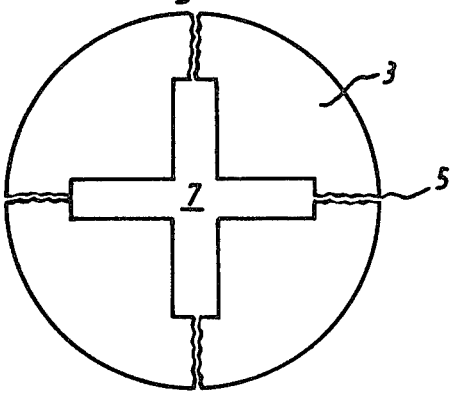
Figure 2D:
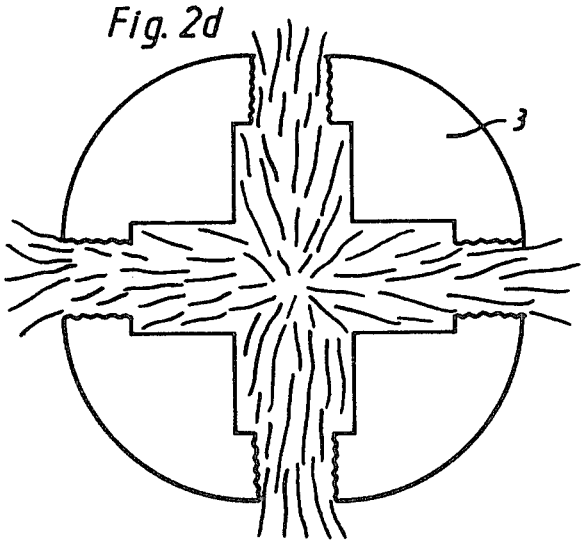

In the case 1, the smoke or combustion charge compounds are arranged as disc shaped pressed objects 3, stacked on one another. The external diameter and the shape of the disc shaped pressed objects corresponds to the internal diameter and the shape of the case 1. The pressed objects 3 have grooves 4, which are preferably arranged axis-symmetrically and include the central region. In FIGS. 1 and 2, cross-shaped grooves are presented, but they can also be constructed star-shaped with any number of points, or even rounded leaf-shaped, or as simple rectangular slits.

The parts of the grooves 4 shown at the outer edge simultaneously form preset breaking points 5 with the decomposition of the pressed object 3, and are lined up above one another by means of a removable centering rod which reproduces the shape of the grooves 4, in such a way that the grooves form a continuous channel 6. Subsequently, space filling igniting charge pressed objects 7 are introduced into the channel 6. By the shape of the pressed object 4, the case 1 is completely filled, whereby a central internal ignition pipe is superfluous. The formed channel 6 is also completely filled by means of the igniting charge pressed objects 7, so that a premature dissipation of the charge with transport is excluded, and a direct contact is obtained between the igniting charge and the smoke or combustion charge. The disc shaped pressed objects are easily produced and also easily inserted in the case.

At the time of ignition of the charge, the igniting charge pressed objects 7 burn through, ignite the pressed objects 3 of the smoke or combustion charge, which burst through grooves 4 at the specified preset breaking points 5, whereupon on the basis of the internal pressure becoming stronger, the case bursts at the preset breaking points arranged there. In that way, the separate parts of the pressed objects 3 of the smoke or combustion charge decompose further, and are distributed in all directions. The three components igniting charge, smoke or combustion charge, and the case act together optimally, since the ignition and pressure buildup occur at the same time. According to the specified and variable decomposition energy, the separate parts distribute themselves over a definable field, whereby, e.g., a homogeneous smoke is produced.

The smoke or the combustion segments are quickly and at the same time permanently produced. The smoke or combustion time can also be controlled, especially by variation of their composition as well as by different thicknesses of the pressed object, whereby different combustion times are achieved.

The disadvantage of the known smoke compounds, such as acid reaction of the smoke particles, storage instability and inclination to burning time changes, are avoided by a smoke charge which has the following composition in weight percent:

| | |
|---|---|
| Ammonium Chloride | 5–25 |
| Ammonium Perchlorate | 20–70 |
| PVC | 0–25 |
| Thiourea | 0–30 |
| Metal Oxide (ZnO, MgO) | 5–40 |
| Aluminum Powder and/or Magnesium Below 100 μm | 0–11 |
| Binder | 5–30 |

The preferred binder is an elastomer or a polymer based on natural rubber.

The preferred compositions of smoke charges have the following composition, weight percent:

| | | |
|---|---|---|
| (a) | PVC powder | 11.0 |
| | Zinc Oxide | 16.0 |
| | Ammonium Chloride | 11.0 |
| | Thiourea | 13.2 |
| | Ammonium Perchlorate | 36.3 |
| | Elastomer | 13.0 |
| (b) | Aluminum Powder Smaller Than 60 μm | 8.0 |
| | Zinc Oxide | 15.0 |
| | Ammonium Chloride | 14.0 |
| | Ammonium Perchlorate | 50.0 |
| | Magnesium Powder Smaller Than 60 μm | 3.0 |
| | Elastomer | 10.0 |

According to the invention, the smoke compounds are produced in the form of pressed objects in such a way that the components are mixed with a binder containing a solvent, dried, pulverized with a grinding macerator, and are subsequently compressed to pressed objects with use of a pressure of 500 to 1500 bar. By this process, especially stable pressed objects are produced which have a high mechanical loading capacity and are not burst apart into small pieces. The high mechanical stability of the pressed objects is to be attributed to several factors. It results from the mixing of the individual components, from the completely irregular chip shape of the particles, and their compression under pressure. The objects are to be produced in various sizes up to at least 155 caliber. The burning time can be controlled by variation of the thickness of the pressed object.

In the following, a concrete type example of the production of pressed objects of a smoke charge is cited.

A formulation of 2.2 kg of PVC powder, 3.3 kg of zinc oxide (dried), 2.2 kg of ammonium chloride, and 2.64 kg of thiourea is pressed through a sieve with a mesh width of 0.3 to 0.55 mm and subsequently mixed intensively. Then the formulation is brought into a kneading machine and stirred to a paste with 2.4 kg (based on the solid portion, i.e. without the solvent portion) of a highly viscous elastomer binder for 15 minutes. After completion of the kneading process, ammonium perchlorate processed by the same sieving procedure is added in a quantity of 7.26 kg. This formulation is kneaded a further 15 minutes, then spread out on screens and subsequently dried for 6 hours at a temperature of 45° C. Subsequently, the dried batch obtained is pulverized in a grinding macerating machine, and finally compressed to pressed objects at a pressure of about 1000 bar.

A pyrotechnic charge as a combustion charge has the following composition in weight percent:

| | |
|---|---|
| Iron (III) Oxide | 20–50 |
| Aluminum Powder | 10–20 |
| Calcium Silicide, Silicon, Ferro-Silicon, or copper/aluminum alloy | 3–15 |
| Magnesium Powder 100 μm | 3–10 |
| Magnesium Powder 300 μm | 5–10 |
| Amorphous Boron | 2–10 |
| Binder | 10–20 |

The production takes place so that the mentioned substances without binder are brought into a mixer and are mixed with the binder, preferably an elastomer binder, and then granulated. The finished granules are dried for 5 hours on drying screens and subsequently are compressed to molded objects.

The igniting charges for pyrotechnic charging, which contain the magnesium powder, black powder flour, an oxygen donor and a binder, have, in order to obtain precise, definite and constant ignition conditions, a magnesium powder with a grain size below 60 μm, and amorphous boron in addition. For acceleration of the burning, a catalyst can additionally be provided, preferably in the form of an iron(II)-iron(III) complex—especially Prussian blue. Solid chlorparaffin serves as a binder.

According to the invention, igniting charges have the following composition, weight percent:

| | |
|---|---|
| Magnesium | 10–25 |
| Black Powder Flour | 30–55 |
| Amorphous Boron | 15–35 |
| Prussian Blue | 3–15 |
| Solid Chloroparaffin | 3–15 |
| A preferred composition has, in weight percent: | |
| Magnesium | 12.0 |
| Black Powder Flour (70–75 wt. % potassium nitrate, 20–25 wt. % sulfur, 5–15 wt. % wood charcoal) | 47.1 |
| Amorphous Boron | 23.9 |
| Prussian Blue | 9.0 |
| Solid Chloroparaffin | 8.0 |

The components of the igniting charge are mixed in a solvent, dried, granulated, and subsequently are compressed to molded objects with the use of applied pressures of from 500 to 4000 bar.

In the following, a concrete type example of the production of pressed objects for an igniting charge is cited.

1.2 kg of magnesium powder and 0.9 kg of Prussian blue are mixed well with one another in a mixing vessel. 0.8 kg of chloroparaffin (powdery) which was dissolved in 2 liters of perchloroethylene is added to this premixture. The solution is well blended with the premixture in a mixer for 10 minutes. Thereafter, 2.39 kg of amorphous boron are added and the mixing process is repeated for 5 minutes. As the last component, 4.71 kg of black powder flour (on a 2 component basis, i.e. without sulfur addition) are added to the mixing vessel and allowed to mix again for 10 minutes. Thereafter, the solvent moist charge is shaken through a 1.5 mm sieve and spread out on drying screens. After a drying time of 5 hours at 45° C., the charge can be compressed to bars with an applied pressure of 1500 bar.

The igniting charge according to the invention is distinguished by precise and constant ignition processes and a high mechanical loading capacity.

We claim:

1. A pyrotechnic smoke charge in the form of separate pressed objects (3) arranged in a case, the improvement comprising the case (1) is of a material selected from a group consisting of plastic or light metal provided with a multitude of preset breaking points (2), wherein the pressed objects (3) of the smoke charge are provided with openings (4) in the form of axis-symmetrically grooves, the objects (3) being arranged in layers above one another whereby the openings (4) form a continuous channel (6) in which separately acting igniting charges (7) are arranged filling the channel.

2. A process for the production of a pyrotechnic smoke charge containing a chlorine donor, a metal oxide and ammonium chloride having the following composition (in weight percent):

| | |
|---|---|
| Ammonium Chloride | 5–25 |
| Ammonium Perchlorate | 20–70 |
| PVC | 0–25 |
| Thiourea | 0–30 |
| Metal Oxide | 5–40 |
| Aluminum Powder and/or Magnesium Below 100 μm | 0–11 |
| Binder | 5–30 |

comprising the steps:

a. mixing the components with one another with a solvent containing the binder;

b. drying the mixture;

c. pulverizing the mixture with a grinding macerator;

d. subsequently pressing the mixture to pressed objects which have openings in the form of axis symmetrical grooves with use of a pressure of 500 to 1000 bar;

e. arranging the objects in layers above one another within a case which is of a material selected from a group consisting of plastic or light metal provided with a multitude of preset breaking points and whereby the openings form a continuous channel; and f. filling the channel with separately acting igniting charges.

3. A process for the production of a pyrotechnic combustion charge having the following composition (in weight percent):

| | |
|---|---|
| Iron (III) Oxide | 20–50 |
| Aluminum Powder | 10–20 |
| Calcium Silicide, Silicon, Ferro-Silicon or Copper/Aluminum Alloy | 3–15 |
| Magnesium Powder 100 μm | 3–10 |
| Magnesium Powder 300 μm | 3–10 |
| Amorphous Boron | 2–10 |
| Binder | 10–20 |

comprising the steps:

a. mixing the substances with an elastomeric binder;
b. granulating the mixture;
c. drying the finished granules for at least 5 hours on drying racks;
d. subsequently pressing the mixture to pressed objects which have openings in the form of axis symmetrical grooves.
e. arranging the objects in layers above one another within a case which is of a material selected from a group consisting of plastic or light metal provided with a multitude of preset breaking points and whereby the openings form a continuous channel; and
f. filling the channel with separately acting igniting charges.

4. The pyrotechnic charge of claim 1 as a smoke charge containing a chlorine donor, a metal oxide and ammonium chloride, have the following composition (in weight percent):

| | |
|---|---|
| Ammonium Chloride | 5–25 |
| Ammonium Perchlorate | 20–70 |
| PVC | 0–25 |
| Thiourea | 0–30 |
| Metal Oxide | 5–40 |
| Aluminum Powder and/or Magnesium Below 100 μm | 0–11 |
| Binder | 5–30 |

5. The pyrotechnic charge of claim 4, wherein the binder is an elastomer or a polymer based on natural rubber.

6. The pyrotechnic charge of claim 4 having the following composition (in weight percent):

| | |
|---|---|
| PVC Powder | 11.0 |
| Zinc Oxide | 16.0 |
| Ammonium Chloride | 11.0 |
| Thiourea | 13.2 |
| Ammonium Perchlorate | 36.3 |
| Elastomer | 13.0 |

7. The pyrotechnic charge of claim 4 having the follwoing composition (in weight percent):

| | |
|---|---|
| Aluminum Powder Smaller Than 60 μm | 8.0 |
| Zinc Oxide | 15.0 |
| Ammonium Chloride | 14.0 |
| Ammonium Perchlorate | 50.0 |
| Magnesium Powder Smaller Than 60 μm | 3.0 |
| Elastomer | 10.0 |

8. A process for the production of a combustion charge containing a magnesium powder, black powder flour, an oxygen donor, and a binder containing igniting charge, wherein the magnesium powder has a grain size below 100 μm, comprising the steps:

a. mixing the igniting compound with a solvent containing the binder;
b. drying the mixture;
c. granulating the mixture;
d. subsequently pressing the mixture in a mold to form pressed objects with openings in the form of axis symmetrical grooves with use of a pressure of 500 to 4000 bar;
e. arranging the objects in layers above one another within a case which is of a material selected from a group consisting of plastic or light metal provided with a multitude of preset breaking points and whereby the openings form a continuous channel; and
f. filling the channel with separately acting igniting charges.

9. The pyrotechnic charge of claim 1 as a combustion charge having the following composition (in weight percent):

| | |
|---|---|
| Iron (III) Oxide | 20–50 |
| Aluminum Powder | 10–20 |
| Calcium Silicide, Silicon, Ferro-Silicon or Copper/Aluminum Alloy | 3–15 |
| Magnesium Powder 100 μm | 3–10 |
| Magnesium Powder 300 μm | 3–10 |
| Amorphous Boron | 2–10 |
| Binder | 10–20 |

10. The pyrotechnic charge of claim 1 containing a magnesium powder, black powder flour, an oxygen donor, and a binder containing igniting charge, wherein the magnesium powder has a grain size below 100 μm.

11. The pyrotechnic charge of claim 10, wherein the igniting charge additionally contains amorphous boron.

12. The pyrotechnic charge of claim 10, wherein the igniting charge has additionally a catalyst.

13. The pyrotechnic charge of claim 10, wherein the binder of the igniting charge is solid chloroparaffin.

14. The pyrotechnic charge of claim 10, wherein the igniting charge has the following composition (in weight percent):

| | |
|---|---|
| Magnesium | 10–25 |
| Black Powder Flour | 30–55 |
| Amorphous Boron | 15–35 |
| Prussian Blue | 3–15 |
| Solid Chloroparaffin | 3–15 |

15. The pyrotechnic charge of claim 14, wherein the igniting charge has the following composition (in weight percent):

| | |
|---|---|
| Magnesium | 12.0 |
| Black Powder Flour (70–75 wt. % potassium nitrate, 20–25 wt. % sulfur, 5–15 wt. % wood charcoal) | 47.1 |
| Prussian Blue | 9.0 |
| Solid Chloroparaffin | 8.0 |

16. The pyrotechnic charge of claim 10, wherein the magnesium powder has a grain size below 60 μm.

17. The pyrotechnic charge of claim 12, wherein the catalyst is iron (II)-iron (III) complexes.

18. The pyrotechnic charge of claim 17, wherein the catalyst is Prussian Blue.

* * * * *